US005351733A

United States Patent [19]

Ullman

[11] Patent Number: 5,351,733

[45] Date of Patent: Oct. 4, 1994

[54] REVERSIBLE DOOR PROTECTIVE DEVICE

[76] Inventor: Donald L. Ullman, 10825 Havenhurst, Peoria, Ill. 61615

[21] Appl. No.: 44,675

[22] Filed: Apr. 9, 1993

[51] Int. Cl.[5] ..... B65D 75/28

[52] U.S. Cl. ..... 150/154; 206/321

[58] Field of Search ..... 150/154, 155, 901; 206/321, 325

[56] References Cited

U.S. PATENT DOCUMENTS

| | | | |
|---|---|---|---|
| 1,669,616 | 5/1928 | Johnson . | |
| 1,675,147 | 6/1928 | Walter | 206/321 X |
| 2,757,854 | 8/1956 | Wall | 206/321 X |
| 4,372,364 | 2/1983 | Katz | 150/154 |
| 5,042,656 | 8/1991 | Kahre | 150/154 X |
| 5,123,223 | 6/1992 | Makarevich et al. | 52/311 |
| 5,255,727 | 10/1993 | Sabruwatari et al. | 150/154 |

*Primary Examiner*—Sue A. Weaver

*Attorney, Agent, or Firm*—Shlesinger, Arkwright & Garvey

[57] ABSTRACT

A reversible door protective device for left-and right-side doors for preventing damage that may be caused during moving of articles through a doorway, includes a generally planar flexible panel of a length corresponding to the length of a door but slightly wider thereto. The panel includes a reversible pocket for engaging with the outer top corner portion of the door and an elastic loop for engaging with the inner top corner portion of the door lying adjacent the hinge of the door. The panel includes left and right side flaps each extending along the length thereof for protecting the side edge portions of the door. The pocket includes an opening that extends along one of the surfaces of the panel. Upon reversing the pocket, however, the opening extends along the opposite surface of the panel.

20 Claims, 3 Drawing Sheets

FIG. 3
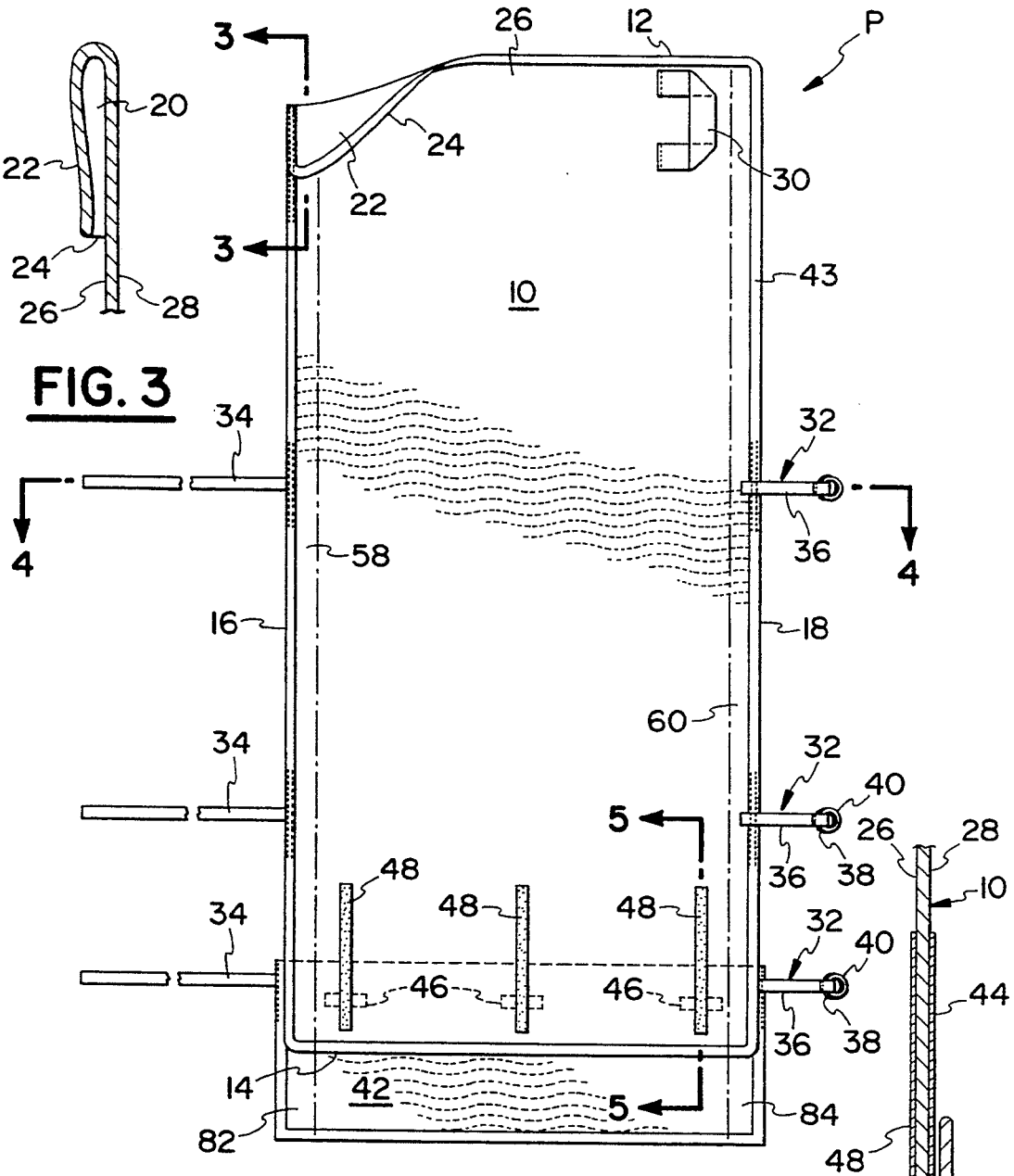
FIG. 1
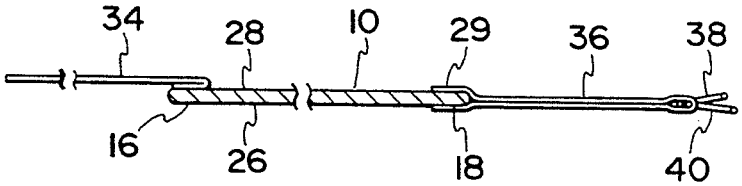
FIG. 4
FIG. 5

REVERSIBLE DOOR PROTECTIVE DEVICE

FIELD AND HISTORICAL BACKGROUND OF THE INVENTION

The present invention is directed to a door protective device for preventing damage that may be caused during moving of articles through a doorway. More particularly, the present invention is directed to a door protective device which can be reversed for use on a left-side or a right-side door.

In modern times, it is not uncommon that furniture and other articles used in a typical household or in a commercial setting be transferred from one place to the other within a building or from one building to another. Moving of large articles through various doorways is therefore frequently necessary. It is a common experience that during such move, damage to the door, doorways, or other building surfaces is caused due to inadvertent contact or insufficient maneuvering of the articles or dollies through the doorways. To prevent this type of damage, it is a common practice to cover the articles being moved with a padded material or blankets. However, this practice is not frequently utilized as it requires covering and uncovering of individual articles being moved. Moreover, this practice requires the use of a large number of padded material if different items are being moved by different persons. This practice further has a disadvantage in requiring that padded material of different sizes be kept to cover articles of varying sizes. Another commonly used technique is to cover the woodwork, especially the edge and face of swinging doors, with padded blankets. This also does not work well since the blankets have a tendency either to slide-off the door or to inadequately cover the surface. In addition, this technique is time-consuming because in order to protect a door properly, the blankets must be taped or otherwise secured in place.

Various door protectors and the like-devices have been proposed in the art, such as those disclosed in U.S. Pat. Nos. 1,669,616; 4,372,364; 5,042,656; and 5,123,223.

OBJECTS AND SUMMARY OF THE INVENTION

The main object of the present invention is to provide a door protective device for preventing damage that may be caused during moving of articles through a doorway, which device can be reversed to be used on a left-side or a right-side door.

Another object of the present invention is to provide a door protective device which, in addition to protecting the door panel, also prevents damage to the side edges thereof.

Yet another object of the present invention is to provide a door protective device which is simple in construction and easy to use, and further is versatile in that it can be easily adjusted for use with doors of different heights.

An additional object of the present invention is to provide a door protective device which upon applying to a door panel, remains completely secure on the door and does not flap loose at the bottom thereby providing greater door protection.

In summary, the main object of the present invention is to provide a reversible protective device for left- and right-side doors which can be effectively used to prevent damage to the door panels and the side edges thereof.

BRIEF DESCRIPTION OF THE DRAWINGS

The above and other objects and advantages and novel features of the present invention will become apparent from the following detailed description of the preferred embodiment of the present invention illustrated in the accompanying drawings, in which:

FIG. 1 is a top plan view of the door protective device of the invention;

FIG. 3 is a fragmentary sectional view taken along line 3—3 of FIG. 1;

FIG. 4 is a sectional view taken along line 4—4 of FIG. 1;

FIG. 5 is a fragmentary sectional view taken along line 5—5 of FIG. 1;

DETAILED DESCRIPTION OF THE INVENTION

Figure 2:
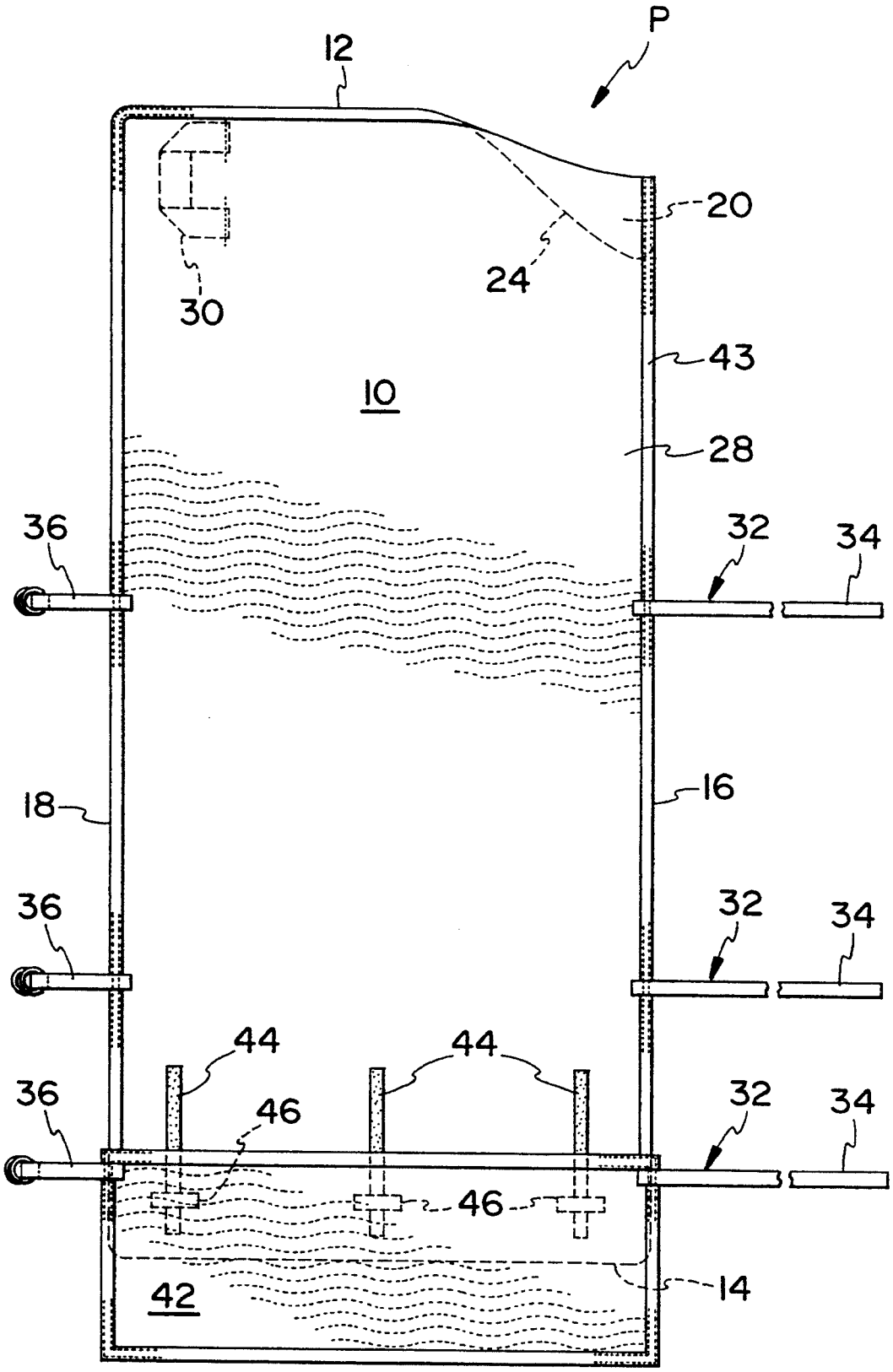
FIG. 2 is a bottom plan view of the device shown in FIG. 1.

As best shown in FIGS. 1 and 2, the door protective device P of the present invention is in the form of a generally planar padded panel 10, preferably made from a cloth material. Panel 10 has the configuration of a door having a length that corresponds to the length of a door but a width slightly greater than the width of a door on which it will be used. (It should be noted that the length and width dimensions of panel 10 can be varied so as to accommodate doors of varying widths and/or lengths.)

Panel 10 includes top 12, bottom 14 and left and right sides 16 and 18, respectively. A pocket 20, adjacent top 12, is formed by folding over panel portion 22 on the left side 16. Pocket 20 has opening 24 which, as shown in FIG. 1, extends along panel surface 26. When the pocket 20 is reversed by inverting outwardly panel portion 22, pocket opening 24 extends along the opposite panel surface 28, see FIG. 7.

An elastic strap 30, in the form of a loop, is provided along top 12 on panel surface 26. Loop 30, as best shown in FIGS. 1 and 2, is disposed generally opposite to pocket 20 and is spaced inwardly a distance from panel side 18. The reason for this specific construction is that when loop 30 is positioned over a top corner of a door, a panel portion lying generally between loop 30 and side 18 functions as a flap that can be wrapped around the edge of a door, see FIGS. 6–8.

Two nylon strap-fasteners, designated by numeral 32, are fastened to the sides of panel 10. Each fastener 32 includes a plain belt-like section 34 fastened to the panel 10 on its surface 28 about side 16, and a corresponding section 36 fastened to both panel surfaces 26 and 28 by its bifurcated end 29 at its right side 18. As best seen in FIGS. 1, 2 and 4, section 36 of strap fasteners 32 is provided with rings 38 and 40 for fastening with belt-section 34, in a known manner. (It should be noted that other conventional types of fasteners may also be used for securing the protective device to a door.)

Preferably, one strap-fastener 32 is provided about midway the length of panel 10 and another fastener 32 is provided towards the bottom thereof such that when panel 10 is mounted on a door, fasteners 32 securely hold the protective device P on the door. It should be noted that while only two fasteners 32 are shown to be provided on panel 10, it is well within the scope of this invention to vary the number thereof for an improved performance of the device.

As best shown in FIGS. 1, 2 and 5, an extension 42, made from a similar material as panel 10, is provided which can be readily attached to the panel bottom by Velcro strips 44 and 46 provided on panel surface 28 and extension 42, respectively. As best shown in FIGS. 1 and 5, Velcro strips 48, similar to Velcro strips 44, are provided on opposite panel surface 26 so that the extension 42 can also be fastened to panel 10 when the protective device P is reversed. As best shown in FIGS. 1 and 2, a strap-fastener 32 is also provided on extension 42 in the same manner as the fasteners 32 on panel 10.

As described below in connection with the use and operation of the present device, and shown in FIGS. 1 and 6–8, left and right side portions 58 and 60 of panel 10, each extending along the length thereof, functions to substantially cover and protect the side edge portions of a door. The extension 42 likewise forms left and right side flaps 82 and 84, respectively, that work to protect door edge portions in conjunction with flaps 58 and 60. In FIGS. 1 and 2, reference numeral 43 designates a border around the perimeter of panel 10.

USE AND OPERATION

Figure 6:
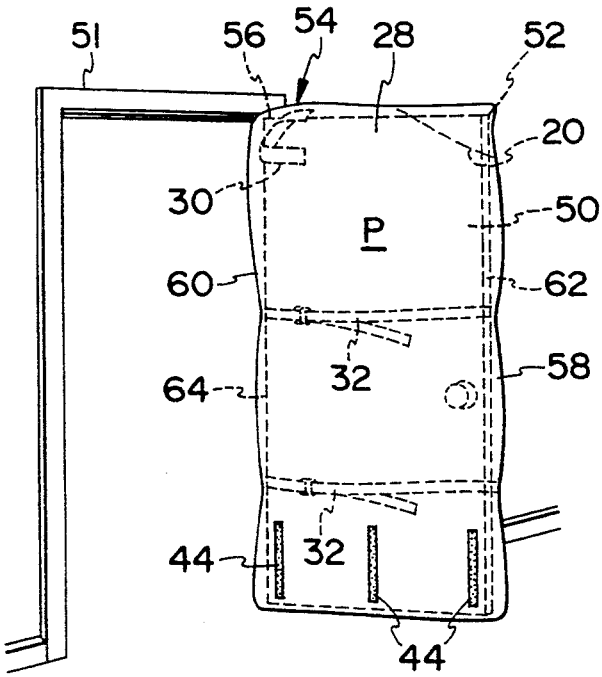
FIG. 6 illustrates the use of the device in connection with a left-side door.

FIG. 6 illustrates a left-side door 55 hung on frame 51 at hinge portion 54. The protective device P of the invention is simply placed over the left-side door 50 by stretching pocket 20 over outer top corner portion 52 of the door that lies away from door hinge 54. The elastic loop 30 is stretched over inner top corner portion 56 of the door which lies adjacent the door hinge 54. The panel 10 is then secured over door 50 by fastening straps 32. As notes previously, panel 10 is slightly wider than the door. Therefore, when the device P is fastened on the door 50, outer length-wise left and right side portions of panel 10 form flaps 58 and 60, respectively, which substantially cover the corresponding edge portions 62 and 64 of door 50. It should be noted that in this application of device P, Velcro strips 44 would be exposed to the exterior and Velcro strips 48 would be adjacent the door.

Figure 7:
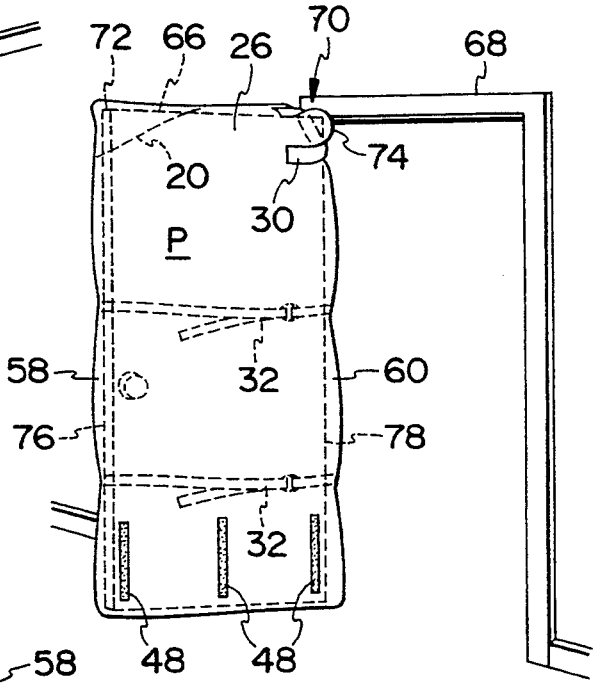
FIG. 7 illustrates in reverse position the use of the device of FIG. 6 in connection with a right-side door.

FIG. 7 illustrates a right-side door 66 hung on frame 68 at hinge portion 70. Prior to placing protective device P on the right-side door 66, panel 10 is reversed by reversing pocket 20 such that pocket opening 24 now lies along panel side 28. It should be noted, however, that elastic loop 30 remains on panel side 26 on which it is mounted. The device P is then secured over door 66 by first stretching pocket 20 over outer top corner portion 72 of the door, and then stretching elastic loop 30 on the inner top corner portion 74 of the door that lies adjacent hinge 70. Panel 10 is then further secured on the door 66 by fastening straps 32 around the door in a known manner. Left and right flaps 58 and 60 of the panel 10 substantially cover corresponding left and right edge portions 76 and 78 of the door 66.

It should be noted that when the protective device P is reversed to be used in connection with right-side door 66 (FIG. 7), Velcro strips 48 would be exposed to the exterior and Velcro strips 44 on the opposite panel side would be adjacent the door.

Figure 8:
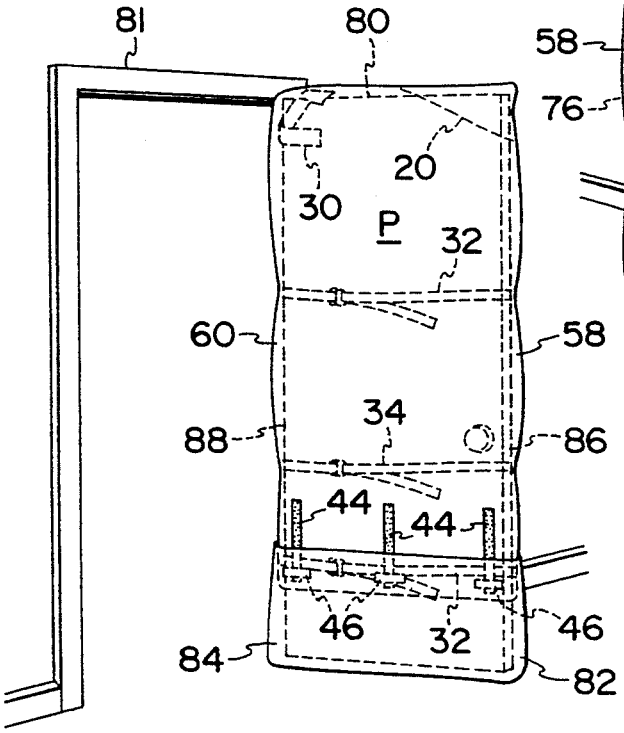
FIG. 8 illustrates the use of the bottom extension in connection with a longer door.

FIG. 8 illustrates the use of extension 42 in connection with a left-side door 80, hung on frame 81, which is longer than the left-side door shown in FIG. 6. Protective device P is placed on the door 80 in the same manner as described above in connection with door 50. (It should be noted that since door 80 is longer than panel 10, a bottom portion thereof would remain uncovered.) Extension 42 is then placed on panel 10 along its bottom such that extension 42 completely covers the bottom portion of door 80 that remained uncovered by panel 10. Then, Velcro strips 46 on extension 42 are interconnected with corresponding Velcro strips 44 on panel 10 for securing the extension on panel 10. The fastener 32 of extension 42 is then wrapped around the door bottom in a known manner. Extension 42 also forms left and right flaps 82 and 84, which together with left and right flaps 58 and 60 of panel 10, substantially cover and protect left and right edge portions 86 and 88 of door 80. In the event of a right-side door which is longer than the length of panel 10, the extension 42 can be used by attaching it to Velcro strips 48, see FIG. 7.

It will be apparent to those of ordinary skill in the art that the lengths of Velcro strips 44 and 48 and their location on panel 10, together with the length of extension 42, provide the limit by which the effective length of the protective device P can be extended for use on doors that are longer than the length of panel 10. It is therefore well within the scope of this invention to vary these perimeters for accommodating doors of different lengths, as well as of different widths.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

What is claimed is:

1. An integral door protective device for preventing damage that may be caused to a door during moving of articles through a doorway, the door having left and right edge portions and hung in a frame, the device comprising:

a) a generally planar flexible panel member having a length substantially corresponding to the length of the door and a width slightly larger than the width thereof;

b) said panel member including top, bottom, left and right sides;

c) said panel member including reversible pocket means adjacent the top thereof for engaging a first top corner portion of the door;

d) flexible loop means disposed adjacent the top of said panel member and generally opposite to said pocket means for engaging a second top corner portion of the door;

e) fastener means attached to said panel member for removably securing the protective device to the door;

f) said panel member including uninterrupted left and right side flaps each extending along the length thereof for protecting the corresponding left and right edge portions of the door;

g) said panel member including first and second opposed surfaces; and h) said pocket means including an opening extending along one of said first and second surfaces of said panel member;

i) wherein when said pocket means is reversed said opening thereof extends along the other of said first and second surfaces of said panel member.

2. The door protective device of claim 1, and including:

a) extension means attachable to said panel member for extending the length thereof.

3. The door protective device of claim 2, wherein:

a) said panel member and said extension means are both made of the same material.

4. The door protective device of claim 1, wherein:

a) said pocket means extends only along a portion of the top of said panel member.

5. The protective device of claim 1, wherein:

a) said fastener means comprises at least one strap-fastener including first and second sections respectively mounted to left and right sides of said panel;

b) at least one of said first and second strap sections includes a bifurcated end; and c) said at least one of said first and second strap sections is affixed to the corresponding side of said panel in a manner that a portion of said panel is received between said bifurcated end.

6. The door protective device of claim 1, wherein:

a) said panel member includes a protective border along the perimeter thereof.

7. The door protective device of claim 1, wherein:

a) said panel member is made of a padded material.

8. A reversible door protective device for use on a left or a right side door hung in a frame by hinge means, the door including a left edge portion hinged to a first side portion of the frame and a free right edge portion lying adjacent a second side portion of the frame, the device comprising:

a) a generally planar flexible panel member having a length substantially corresponding to the length of a door and a width slightly larger than the width thereof;

b) said panel member including top, bottom, left and right sides;

c) said panel member including reversible pocket means adjacent the top thereof for engaging a first top corner portion of the door lying away from the first side portion of the door frame;

d) flexible loop means disposed adjacent the top of said panel member and generally opposite to said pocket means for engaging a second top corner portion of the door lying adjacent the first side portion of the door frame;

e) fastener means attached to said panel member for removably securing the protective device to the door;

f) said panel member including first and second opposed surfaces;

g) said pocket means including an opening extending along one of said first and second surfaces of said panel member;

h) said panel member being reversible between first and second positions for use on left and side doors, respectively;

i) said panel member including left and right side flaps each extending along the length thereof for protecting the corresponding left and right edge portions of the door; and j) said fastener means comprising at least one strap-fastener including first and second sections respectively mounted to left and right sides of said panel;

k) wherein when said pocket means is reversed said opening thereof extends along the other of said first and second surfaces of said panel member;

l) wherein regardless of said first and second positions of said panel member, said pocket means engages the top corner portion of the door lying away from the first side portion of the frame and said loop means engages the top corner portion of the door lying adjacent the first side portion of the frame.

9. The door protective device of claim 8, and including:

a) extension means attachable to said panel member for extending the length thereof.

10. The door protective device of claim 9, wherein:

a) said panel member and said extension means are both made of the same material.

11. The door protective device of claim 8, wherein:

a) said pocket means extends only along a portion of the top of said panel member.

12. The protective device of claim 8, wherein:

a) at least one of said first and second strap sections includes a bifurcated end; and b) said at least one of said first and second strap sections is affixed to the corresponding side of said panel in a manner that a portion of said panel is received between said bifurcated end.

13. The door protective device of claim 8, wherein:

a) said panel member includes a protective border along the perimeter thereof.

14. The door protective device of claim 8, wherein:

a) said panel member is made of a padded material.

15. A door protective device for preventing damage that may be caused to a door during moving of articles through a doorway, the door having left and right edge portions and hung in a frame, the device comprising:

a) a generally planar flexible panel member having a length substantially corresponding to the length of a door and a width slightly larger than the width thereof;

b) said panel member including top, bottom, left and right sides;

c) said panel member including reversible pocket means adjacent the top thereof for engaging a first top corner portion of the door;

d) flexible loop means disposed adjacent the top of said panel member and generally opposite to said pocket means for engaging a second top corner portion of the door;

e) fastener means attached to said panel member for removably securing the protective device to the door;

f) said panel member including left and right side flaps each extending along the length thereof for protecting the corresponding left and right edge portions of the door;

g) said panel member including first and second opposed surfaces;

h) said pocket means including an opening extending along one of said first and second surfaces of said panel member; and i) said fastener means comprising at least one strap-fastener including first and second sections respectively mounted to left and right sides of said panel;

j) wherein when said pocket means is reversed said opening thereof extends along the other of said first and second surfaces of said panel member.

16. The door protective device of claim 15, and including:

a) extension means attachable to said panel member for extending the length thereof.

17. The door protective device of claim 16, wherein:

a) said panel member and said extension means are both made of the same material.

18. The door protective device of claim 15, wherein:

a) said pocket means extends only along a portion of the top of said panel member.

19. The protective device of claim 15, wherein:

a) at least one of said first and second strap sections includes a bifurcated end; and b) said at least one of said first and second strap sections is affixed to the corresponding side of said panel in a manner that a portion of said panel is received between said bifurcated end.

20. The door protective device of claim 15, wherein:

a) said panel member includes a protective border along the perimeter thereof.

* * * * *